United States Patent [19]

Gay et al.

[11] Patent Number: 4,559,170

[45] Date of Patent: Dec. 17, 1985

[54] DISPOSAL OF BEAD ION EXCHANGE RESIN WASTES

[75] Inventors: Richard L. Gay, Canoga Park; LeRoy F. Grantham, Calabasas, both of Calif.

[73] Assignee: Rockwell International Corporation, El Segundo, Calif.

[21] Appl. No.: 548,267

[22] Filed: Nov. 3, 1983

[51] Int. Cl.[4] ..... G21F 9/08; G21F 9/28

[52] U.S. Cl. ..... 252/628; 159/4.02; 159/48.1; 159/DIG. 12; 252/632; 252/626

[58] Field of Search ..... 252/628, 632, 626; 110/237, 238; 159/4.01, 4.02, 48.1, DIG. 12; 34/10, 57 R

[56] References Cited

U.S. PATENT DOCUMENTS

| | | | |
|---|---|---|---|
| 3,101,258 | 8/1963 | Johnson | 252/632 X |
| 3,922,974 | 12/1975 | Hempelmann | 110/8 R |
| 4,002,524 | 1/1977 | Damgaard-Iverson | 159/48.1 |
| 4,008,171 | 2/1977 | Tiepel et al. | 252/632 |
| 4,053,432 | 10/1977 | Tiepel et al. | 252/632 |
| 4,145,396 | 3/1979 | Grantham | 423/22 |
| 4,204,974 | 5/1980 | Puthawala et al. | 252/632 |
| 4,499,833 | 2/1985 | Grantham | 252/631 |

*Primary Examiner*—John F. Terapane
*Assistant Examiner*—Virginia B. Caress
*Attorney, Agent, or Firm*—H. Fredrick Hamann; Harry B. Field; Clark E. DeLarvin

[57] ABSTRACT

Bead ion exchange resin wastes are disposed of by a process which involves spray-drying a bead ion exchange resin waste in order to remove substantially all of the water present in such waste, including the water on the surface of the ion exchange resin beads and the water inside the ion exchange resin beads. The resulting dried ion exchange resin beads can then be solidified in a suitable solid matrix-forming material, such as a polymer, which solidifies to contain the dried ion exchange resin beads in a solid monolith suitable for disposal by burial or other conventional means.

13 Claims, 1 Drawing Figure

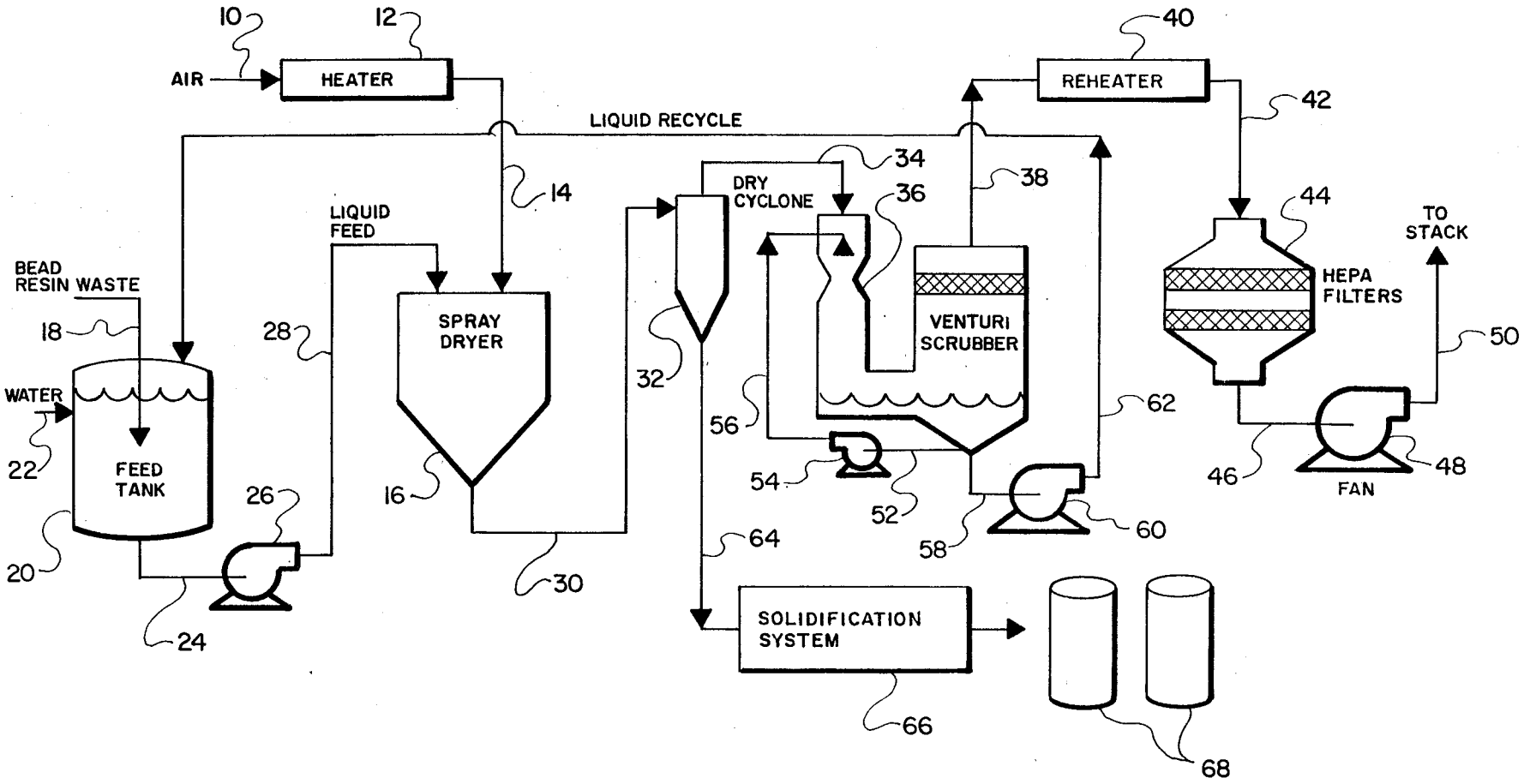
TO STACK
HEPA FILTERS
FAN
REHEATER
VENTURI SCRUBBER
DRY CYCLONE
LIQUID RECYCLE
SOLIDIFICATION SYSTEM
HEATER
SPRAY DRYER
LIQUID FEED
AIR
FEED TANK
BEAD RESIN WASTE
WATER
10
12
14
16
18
20
22
24
26
28
30
32
34
36
38
40
42
44
46
48
50
52
54
56
58
60
62
64
66
68

DISPOSAL OF BEAD ION EXCHANGE RESIN WASTES

BACKGROUND OF THE INVENTION

1. Field of the Invention

This invention relates to waste management and, more particularly, to the disposal of radioactive waste containing bead ion exchange resins. In one of its more particular aspects, this invention relates to a process for reducing the volume of bead ion exchange resin wastes. In another of its more particular aspects, this invention relates to a process for disposing of bead ion exchange resin wastes in the form of solid monoliths.

2. Prior Art

Waste management frequently involves the necessity of disposing of large volumes of materials, some of which may be contaminated with hazardous substances. In nuclear power plants, for example, large amounts of radioactive liquid and solid wastes, known as low-level radioactive wastes, are produced. Low-level radioactive wastes differ from high-level radioactive wastes, which are produced in the reprocessing of nuclear fuels, in that the latter represent greater risks of contamination and, therefore, require disposal techniques which are more stringent than in the case of low-level radioactive wastes. Disposal of radioactive wastes, in general, cannot be readily accomplished by using conventional waste disposal techniques because of the relatively long half-lives of certain radioactive elements. The most widely used disposal techniques for radioactive wastes are storage, solidification, and burial. The expense of so disposing of large volumes of radioactive wastes, however, is constantly rising and approaching levels at which volume reduction becomes economically desirable.

Many different methods for disposing of radioactive wastes are known.

U.S. Pat. No. 3,101,258 describes using a heated wall spray calcination reactor for disposing of nuclear reactor waste solutions. In spray calcination reactors of the heated wall type, however, the temperature gradient from the outside of the reactor inward may result in uneven heating, producing regions of undesired high temperatures and causing non-uniform results.

U.S. Pat. No. 3,922,974 discloses using a hot air-fired furnace for incinerating radioactive wastes. The use of this apparatus, however, results in the production of noxious off-gases, necessitating additional processing for removal of such gases.

U.S. Pat. No. 4,145,396 describes the volume reduction of organic waste material contaminated with at least one volatile compound-forming radioactive element selected from the group consisting of strontium, cesium, iodine, and ruthenium. The selected element is fixed in an inert salt by introducing the organic waste and a source of oxygen into a molten salt bath maintained at an elevated temperature to produce solid and gaseous reaction products. The molten salt bath is comprised of one or more alkali metal carbonates and may optionally include about 1–25 wt % of an alkali metal sulfate. Although effective in reducing the volume of certain organic wastes, the separation of the radioactive components from the nonradioactive components of the molten salt bath requires a number of additional processing steps.

In U.S. patent application Ser. No. 451,516 filed Dec. 20, 1982, now U.S. Pat. No. 4,499,833, and assigned to the assignee of the present invention, there is described a process for converting radioactive wastes in the form of liquids, solids, and slurries into a mixture of a nonradioactive gas and a radioactive inorganic ash. In accordance with that process, the radioactive waste is introduced as a finely atomized spray into a zone heated by means of a hot gas to a temperature sufficient to effect the desired conversion, preferably a temperature in the range of about 600° to 850° C. The process is conducted in a spray dryer modified to combust or calcine the waste.

While the foregoing patent application discloses a process which is satisfactory for destroying radioactive wastes, the high temperatures utilized in the process can produce noxious gases such as $NO_x$ or $SO_x$, the removal of which necessitates taking additional measures to ensure that any gas ultimately released to the atmosphere is non-polluting. In addition, such high temperatures specifically lead to the ignition and combustion of organic materials in the waste.

Consequently, there is a need for a process which can be used to reduce the volume of radioactive wastes without producing noxious off-gases or combusting organic materials present in the wastes. This need is particularly pronounced in the case of liquid low-level radioactive wastes where large volumes of wastes of relatively low radioactivity compound the problems and costs involved in their transportation and disposal.

In U.S. patent application Ser. No. 467,272 filed Feb. 17, 1983, and assigned to the assignee of the present invention, there is disclosed a process for reducing the volume of low-level radioactive wastes by removing the free water contained in the waste by means of spray drying at a temperature sufficient to vaporize the water contained in the waste but insufficient to oxidize the waste or to volatilize any radionuclides present in the waste, preferably a temperature in the range of about 65° to 205° C. The process comprises introducing the waste as a finely atomized spray into a zone heated by means of a hot gas. In this process, contact of the waste particles sprayed into the zone with the hot gas results in the production of a dry, flowable, radioactive solid product and a gaseous, relatively nonradioactive product which contains substantially no $NO_x$ or $SO_x$ and little, if any, volatile radionuclides, which are retained in the solid product. This process is particularly suitable for low-level radioactive wastes such as sodium sulfate slurries, boric acid slurries, and powdered ion exchange resins. In the case of ion exchange resins, however, while this process is capable of drying powdered ion exchange resins, which have a mean diameter in the range of about 50 to 60 microns, bead ion exchange resins, which have a mean diameter in the range of about 500 to 800 microns, are only partially dried by means of this process. In fact, only the free water on or near the surface of the ion exchange resin beads is removed, leaving behind much of the water contained inside the ion exchange resin beads, which constitutes a major proportion of the volume and weight of the ion exchange resin beads.

It is desirable in the processing of various waste materials, and especially radioactive wastes, to reduce the volume of the waste in order to minimize the costs of disposal. Removing the water which is contained inside ion exchange resin beads would significantly reduce the volume of the beads and provide a product which could be disposed of with facility. However, to date no process has been found effective to accomplish this purpose without completely destroying the ion exchange resins and producing oxidation products and noxious gases which further complicate the disposal process.

OBJECTS OF THE INVENTION

It is accordingly an object of this invention to provide a process which is capable of reducing the volume and weight of bead ion exchange resins without oxidizing and combusting the bead ion exchange resins.

Another object of this invention is to provide a process for converting bead ion exchange resin wastes completely into dry solid materials.

Another object of this invention is to provide a process which is adaptable to bead ion exchange resin wastes in solid or slurry form.

Another object of this invention is to provide a process which is capable of removing the water contained inside of ion exchange resin beads.

Another object of this invention is to provide a process which is capable of converting bead ion exchange resin wastes into a form which is readily solidified into a solid monolith.

Another object of this invention is to provide a process which is capable of reducing the volume of bead ion exchange resin wastes in a manner such that the loading of such reduced volume waste in solid matrices is increased.

Another object of this invention is to provide a cost-effective process for safely disposing of bead ion exchange resin wastes.

Other objects and advantages of this invention will become apparent in the course of the following detailed description.

SUMMARY OF THE INVENTION

In general, the present invention provides a process for removing the water present in bead ion exchange resin wastes. Such wastes may be contaminated with radioactive or other hazardous materials which must be safely disposed of. The process comprises introducing a bead ion exchange resin waste into a zone heated by means of a hot gas contained within the zone to a temperature sufficient to vaporize the water on the surface of the ion exchange resin beads and to remove the water inside the ion exchange resin beads, but insufficient to oxidize or combust the bead ion exchange resin waste. A dry, flowable radioactive solid product is thereby produced together with a gaseous product comprising water vapor and containing substantially no oxidation products or combustion products of the bead ion exchange resin. The gaseous product after suitable purification to remove particulates is sufficiently non-polluting to be released to the atmosphere.

The solid product, which is reduced in weight and volume by the removal of water compared to the wet bead ion exchange resin waste, is readily disposable by conventional means such as storage, burial, or incorporation into a solid matrix such as a ceramic, asphaltic, polymeric or concrete monolith prior to storage or burial. Because of the makeup of the ion exchange resins and certain polymeric matrices used for monolithic storage, a preferred embodiment of the present invention utilizes a polymeric matrix which is a vinyl ester-styrene copolymer in order to incorporate large quantities of dried bead ion exchange resins into the monolith resulting from the polymerization of the matrix-forming comonomers.

BRIEF DESCRIPTION OF THE DRAWING

The sole figure of the drawing is a schematic flow diagram illustrating an embodiment of the process of the present invention.

DESCRIPTION OF THE PREFERRED EMBODIMENTS

The process of the present invention accomplishes volume reduction and makes possible the safe disposal of bead ion exchange resin wastes of various types. In particular, low-level radioactive wastes containing bead ion exchange resins having activities within the range of less than about 0.1 to about 100 $\mu Ci/cm^3$ can be treated in accordance with the process of this invention. Such bead ion exchange resin wastes may contain any one or several of the radioactive isotopes frequently encountered in the wastes of nuclear power plants, principally isotopes of Cs, Co, or I, especially $Cs^{134}$, $Cs^{137}$, $Co^{58}$, or $I^{129}$, as well as other commonly encountered radioactive isotopes. Substantially all of the water, both the water on the surface of the ion exchange resin beads and the water inside the porous beads, is removed in order to produce a dry product which contains substantially no water. The bead ion exchange resin waste is contacted in the form of a finely atomized spray with a hot gas to vaporize the water from the waste. The water vaporized from the waste includes interstitial water, the water settled from the waste, and any additional water which has been added for producing a slurry. The water absorbed in the porous resin beads themselves is also removed, there being an equilibrium between the water on the surface of the beads and the water inside the beads. Under the conditions of the process of the present invention, this equilibrium is disturbed by evaporating the water from the surface of the beads and causing the water inside the beads to diffuse outwardly to the surface of the beads and, in turn, to also be evaporated.

A suitable apparatus in which to carry out the process of this invention is a heated gas spray dryer. A hot gas is produced, for example, by burning a suitable gaseous liquid or solid fuel with an excess of an oxygen-containing gas such as air, oxygen-enriched air, or oxygen in a suitable burner. If desired, the hot gas can be provided by means of an electrically heated gas heater or other suitable means. The resulting hot gas is then introduced into the spray dryer at a rate to produce the desired temperature in the spray dryer.

Where a burner is used, any combustible gas such as natural gas or propane, liquid, such as fuel oil or kerosene, or solid fuel, such as coal or coke, can be used in the burner. Fuel oil is preferred as the fuel because of its lower cost and convenience. In any case, the hot gas which contacts the waste consists of a mixture of the oxidation products of the fuel used as well as any unreacted oxygen or air, depending upon the oxygen-containing gas selected. Where an electrically heated gas heater provides the hot gas, any gas of suitable heat capacity such as nitrogen, carbon dioxide, or air can be used.

The temperature of the spray-drying zone is uniformly maintained in the range of about 200° to 450° C., and preferably in the range of about 300° to 350° C., by varying the rate of feeding the hot gas or the ion exchange resin beads into the spray dryer. Temperatures above about 450° C. result in undesired oxidation and destruction of the spray-dried bead ion exchange resin waste and the production of noxious off-gases or the unwanted volatilization of radionuclides. The upper temperature limit is also constrained by the equipment used for particulate removal. At outlet temperatures below about 200° C., the spray-dried ion exchange resin waste is not completely dry. It is, therefore, important that the temperature in the spray-drying zone be uniform so as to avoid the occurrence of unusually hot or unusually cold areas within the zone.

Residence times of about 3 to 12 seconds are suitably used in the process of the present invention. At temperatures within the preferred range, namely about 300° to 350° C., residence times of about 3 to 6 seconds are preferred. If the residence time is increased to about 5 to 10 seconds, the temperature can be lowered to about 275° to 325° C.

A finely atomized spray of the bead ion exchange resin waste being treated is introduced into the spray-drying zone by means of a suitable spray nozzle or other distribution means. The necessary degree of atomization can be achieved by varying the amount of water included in the waste, such as by slurrying the bead ion exchange resin waste in an amount of water to give the desired degree of atomization. Aqueous slurries of bead ion exchange resin wastes or wet bead ion exchange resins can be suitably treated by the process of the present invention.

Spray drying of the bead ion exchange resin waste results in the production of a dry, flowable solid which contains the radioactive contaminants and bead ion exchange resin from which essentially all of the water has been removed and a nonradioactive gas which, after filtering, can be released to the atmosphere as a non-polluting gas.

Substantial volume reductions can be realized according to the process of the present invention. In general, the ratio of the volume of the bead ion exchange resin waste to the volume of the spray-dried ion exchange resin beads is found to be in the range of about 1.5:1 to 3:1.

In a particular embodiment of the present invention, the spray-dried ion exchange resin beads are introduced into a matrix-forming composition to provide a monolithic disposal means. For example, the bead ion exchange resin, which has been spray-dried and which consequently contains essentially no water, is introduced into a ceramic, asphaltic, polymeric or concrete matrix-forming composition in a ratio of dry ion exchange resin beads to solid matrix-forming composition of about 0.35:1 to 4:1 and preferably about 1.5:1 to 2.5:1.

It is preferred to use a polymeric matrix, since the polymer of which the matrix is formed can be of a similar composition to that of the ion exchange resin beads themselves. In particular, a polymer formed from the copolymerization of a mixture of styrene and a vinyl ester, known as Dow polymer, has a composition which is similar to that of the ion exchange resin bead, which is itself composed of a polymeric styrene cross-linked with divinyl benzene and contains various ion exchanging functional groups, such as sulfonic acid or amine groups.

In general, the monolithic disposal means produced in accordance with the process of the present invention display a high water impermeability resulting in the radionuclides present in the monolith being substantially unleachable. A radionuclide leachability below about $10^{-2}$ g/cm$^2$/day is generally obtainable. Leachabilities below about $10^{-4}$ g/cm$^2$/day can be realized and are preferred.

The spray-dried bead ion exchange resin waste contains essentially no water. Thus, it is possible to realize extremely high loading of the various matrix materials, since free standing water is not encountered. A preferred method of practicing the invention is to use a polymeric matrix formed by stirring the spray-dried bead ion exchange resin waste with a low viscosity liquid solution of a vinyl ester and styrene and polymerizing the mixture of monomers by means of a peroxide catalyst and a tertiary amine promoter. A continuous matrix of polymer containing the spray-dried ion exchange resin waste within the polymeric matrix is thereby obtained.

Loading of the matrix to the extent of about 25 to 80% by weight is readily achievable using the above-described polymeric matrix system and the spray-dried ion exchange resin waste produced in accordance with the process of this invention.

Because of the essentially water-free composition, it is also possible to realize even higher waste loading than was previously possible using various other matrix materials. In general, loading in the range of about 25 to 40 wt % is achievable using ceramic, asphaltic, or concrete matrices.

Referring now to the drawing, the sole figure of which illustrates the spray drying and solidification of a bead ion exchange resin waste, air is introduced into a heater 12 via a conduit 10. Heated air is conducted into spray dryer 16 via a conduit 14. Bead ion exchange resin waste in the form of wet solid or aqueous slurry is introduced into a feed tank 20 via a conduit 18. Water, if desired to form a slurry with the wet resin waste, is introduced via a conduit 22. Bead resin waste slurried with water, if desired, is conducted via a conduit 24, a metering pump 26, and a conduit 28 to spray dryer 16. Dried ion exchange beads and product gas exit spray dryer 16 via a conduit 30 and are conducted to a dry cyclone 32 wherein the gaseous product and the solid product are separated. Gaseous product exits dry cyclone 32 via a conduit 34 and is conducted to a Venturi scrubber 36. The scrubbed gas product exits via a conduit 38 and is conducted to a reheater 40. From reheater 40, the heated scrubbed gases are conducted to HEPA filters 44 via a conduit 42. The filtered gaseous product then exits HEPA filters 44 via a conduit 46, a fan 48, and a conduit 50 to the stack. Scrubbing solution for Venturi scrubber 36 is fed via a conduit 52, a pump 54, and a conduit 56 into the high velocity section of Venturi scrubber 36 where it contacts the gaseous product from dry cyclone 32. A portion of the liquid is recycled from Venturi scrubber 36 via a conduit 58, a pump 60, and a conduit 62 to feed tank 20.

The solid product from dry cyclone 32 exits via a conduit 64 to a solidification system 66 wherein spray-dried ion exchange resin beads are processed to provide monolithic disposal means 68 containing the spray-dried ion exchange resin beads.

The invention may be better understood by reference to the following examples which are intended to be illustrative of the process of the present invention and not in any way limitative thereof.

EXAMPLE 1

A spray dryer having a diameter of 76 cm and utilizing a dry cyclone collector to collect the powder product of the spray dryer was used in this example. The cation exchange resin was Gravex-2; the anion exchange resin used was Gravex-1. The bead ion exchange resins were fed as either wet solids or slurries. In the case of the wet solids, the anion exchange resin contained approximately 65% water and the cation exchange resin approximately 35% water. Slurries consisted of approximately 30 wt % solid resin in water. The total water content of the anion exchange resin slurry was 89.5 wt %, and the total water content of the cation exchange resin slurry was 80.5 wt %. Wet solids were fed at average feed rates of 13 to 25 kilograms per hour, and slurries were fed at average feed rates of 17 to 28 liters per hour. Outlet temperatures of the spray dryer varied from 115° to 370° C. Residence times were in the range of 3 to 12 seconds. The results obtained in a series of 15 experiments are shown in the following table.

TABLE

| Ion Exchange Resin Type | Test No. | Feed* | Feed Rate (kg/h) | Feed Rate (l/h) | Temp. at Outlet (°C.) | Total Water Lost (%) |
|---|---|---|---|---|---|---|
| Cation | 1 | W-S | 19 | 25 | 115 | 32 |
| | 2 | W-S | 15 | 20 | 140 | 51 |
| | 3 | W-S | 25 | 33 | 140 | 62 |
| | 4 | W-S | 17 | 23 | 150 | 42 |
| | 5 | W-S | 14 | 19 | 220 | 79 |
| | 6 | S | 16 | 25 | 325 | 98 |
| | 7 | S | 20 | 19 | 335 | 100 |
| | 8 | S | 20 | 19 | 370 | 100 |
| Anion | 9 | W-S | 16 | 26 | 120 | 23 |
| | 10 | W-S | 13 | 21 | 135 | 30 |
| | 11 | W-S | 15 | 24 | 160 | 35 |
| | 12 | W-S | 6 | 10 | 160 | 49 |
| | 13 | W-S | 9 | 15 | 200 | 71 |
| | 14 | S | 17 | 17 | 290 | 74 |
| | 15 | S | 29 | 28 | 310 | 82 |

*W-S = wet-solid, S = slurry

+Amount of weight lost during spray drying compared to amount of weight lost at 125° C. for 500 hours in a convection drying oven.

From the foregoing results, it can be seen that over 70% of the total water present in the ion exchange resin beads can be removed according to the process of the present invention at temperatures of above about 200° C.

The following example illustrates the use of the process of the present invention in producing solid monoliths.

EXAMPLE 2

Spray-dried ion exchange resin beads having a particle size distribution of 80 wt % greater than 300 microns were solidifed using Dow solidification binder 101. A sample of dried ion exchange resin beads was mixed with binder in a dried resin-to-binder ratio of 2:1. A 40% emulsion of benzoyl peroxide in inert diluents was added as catalyst, and a tertiary amine, N, N-dimethyl toluidine was used as promoter. Dow solidification binder 101 is a mixture of styrene and a vinyl ester. After 24 hours the spray-dried ion exchange resin beads were contained in a solidified monolithic mass of binder.

The foregoing example shows that the spray-dried ion exchange resin beads prepared according to the process of the present invention can be solidified into a polymeric monolith suitable for disposal by burial.

It will, of course, be realized that various modifications can be made to the design and operation of the process of this invention without departing from the spirit thereof. For example, baghouse filters can be used instead of the Venturi scrubber in order to achieve purification of the gases produced in the spray dryer. Other solidification polymers than the Dow polymer exemplifed herein, for example, urea-formaldehyde polymers, can be used in order to prepare monolithic disposal means. Thus, while the principle, preferred design and mode of operation of the invention have been explained and what is now considered to represent its best embodiment has been illustrated and described, it should be understood that within the scope of the appended claims, the invention can be practiced otherwise than as specifically illustrated and described.

What is claimed is:

1. A process for reducing the volume of a bead ion exchange resin waste, said beads having a mean diameter of about 500 to 800 microns and said waste being contaminated with a member selected from the group consisting of the radionuclides $Cs^{134}$, $Cs^{137}$, $Co^{58}$, $Co^{60}$, $I^{129}$, and mixtures thereof, said bead ion exchange resin waste containing water on the surface of ion exchange resin beads and water inside said ion exchange resin beads, which consists essentially of:

introducing said bead ion exchange resin waste in the form of a finely atomized spray into a spray drying zone and contacting it with a hot gas stream within said zone, said gas stream having a temperature in the range of about 200° to 450° C. and sufficient to vaporize the water on the surface of said ion exchange resin beads and to remove the water inside said ion exchange resin beads, but insufficient to oxidize or combust said bead ion exchange resin waste or volatilize said radionuclides;

maintaining said bead ion exchange resin waste in said spray drying zone for a residence time of about 3 to 12 seconds;

removing from said zone dry ion exchange resin beads containing said radionuclides and containing substantially no water, and a gaseous nonradioactive product comprising water vapor, said gaseous product containing substantially no oxidation or combustion products of said bead ion exchange resin waste, the ratio of the volume of said bead ion exchange resin waste to said dry ion exchange resin beads being in the range of about 1.5:1 to 3:1; and separating said dry ion exchange resin beads from said gaseous nonradioactive product.

2. A process according to claim 1 wherein said bead ion exchange resin waste comprises an aqueous slurry.

3. A process according to claim 1 wherein said temperature is in the range of about 300° to 350° C.

4. A process according to claim 3 wherein said residence time is about 3 to 6 seconds.

5. A process according to claim 1 wherein said temperature is in the range of about 275° to 325° C. and said residence time is about 5 to 10 seconds.

6. A process according to claim 1 wherein said hot gas is produced by burning a fuel in an excess of an oxygen-containing gas.

7. A process according to claim 1 wherein said hot gas is produced by burning fuel oil in an excess of an oxygen-containing gas.

8. A process according to claim 1 wherein said dry ion exchange resin beads are separated from said gaseous nonradioactive product by passing said mixture of dry beads and gaseous product through a dry cyclone.

9. A process according to claim 1 wherein said hot gas is produced by means of an electrically heated gas heater.

10. A process for disposing of a bead ion exchange resin waste, said beads having a mean diameter of about 500 to 800 microns and said waste being contaminated with a member selected from the group consisting of the radionuclides $Cs^{134}$, $Cs^{137}$, $Co^{58}$, $Co^{60}$, $I^{129}$, and mixtures thereof, said bead ion exchange resin waste containing water on the surface of ion exchange resin beads and water inside said ion exchange resion beads, which consists essentially of:

introducing said bead ion exchange resin waste in the form of a finely atomized spray into a spray drying zone and contacting it with a hot gas stream, said stream having a temperature in the range of about 200° to 450° C. and sufficient to vaporize the water on the surface of said ion exchange resin beads and to remove the water inside said ion exchange resin beads, but insufficient to oxidize or combust said bead ion exchange resin waste or volatilize said radionuclides;

maintaining said bead ion exchange resin waste in said spray drying zone for a residence time of about 3 to 12 seconds;

removing from said zone dry ion exchange resin beads containing said radionuclides and containing substantially no water, and a gaseous nonradioactive product comprising water vapor, said gaseous product containing substantially no oxidation or combustion products of said bead ion exchange resin waste, the ratio of the volume of said bead ion exchange resin waste to said dry ion exchange resin beads being in the range of about 1.5:1 to 3:1;

separating said dry ion exchange resion beads from said gaseous nonradioactive product; and mixing said dry ion exchange resin beads with a solid matrix-forming composition comprising a copolymer of styrene and vinyl ester;

thereby forming a solid monolith containing said dry ion exchange resin beads and having a radionuclide leachability below about $10^{-2}$ g/cm$^2$/day.

11. A process according to claim 10 wherein said leachability is less than about $10^{-4}$ g/cm$^2$/day.

12. A process according to claim 10 wherein said dry ion exchange resin beads are mixed with said solid matrix-forming composition in a ratio of about 0.35:1 to 4:1.

13. A process according to claim 10 wherein said dry ion exchange resin beads are mixed with said solid matrix-forming composition in a ratio of about 1.5:1 to 2.5:1.

* * * * *